United States Patent [19]

Schroder

[11] Patent Number: 4,589,700

[45] Date of Patent: May 20, 1986

[54] STRIP-AUGER METHOD OF MINING THIN SEAMS OF HYDROCARBONACEOUS DEPOSITS

[75] Inventor: Michael L. Schroder, Evergreen, Colo.

[73] Assignee: Standard Oil Company (Indiana), Chicago, Ill.

[21] Appl. No.: 582,049

[22] Filed: Feb. 21, 1984

[51] Int. Cl.[4] ..... E21C 41/00; E21C 47/02

[52] U.S. Cl. ..... 299/18; 299/19

[58] Field of Search ..... 299/55, 19, 18

[56] References Cited

U.S. PATENT DOCUMENTS

| | | | |
|---|---|---|---|
| 4,017,122 | 4/1977 | Simpson | 299/19 X |
| 4,059,163 | 11/1977 | Stedman | 299/18 X |
| 4,150,852 | 4/1979 | McCoy | 299/18 |

*Primary Examiner*—Stephen J. Novosad

*Attorney, Agent, or Firm*—F. F. Fondriest; William T. McClain; William H. Magidson

[57] ABSTRACT

The present invention relates to a combination of open cast strip mining and auger mining of thin seams of hydrocarbonaceous deposits. In this mining method, a first working pit is stripped to expose the deposit, the hydrocarbonaceous material extracted and the exposed deposit seam face of at least one highwall is auger mined. A second and successive working pits are opened parallel to but spaced apart from the preceding working pit by a predetermined distance thereby leaving an undisturbed overburden portion therebetween. In the second and successive working pits, the overburden is stripped and disposed in the void of its preceding pit, the hydrocarbonaceous material extracted and the hydrocarbonaceous material beneath the undisturbed overburden portion between adjacent working pits substantially removed by auger mining from one or both working pits. The stripping is accomplished by the use of a dragline and the width of the undisturbed overburden portion is related to the working radius of the dragline.

22 Claims, 3 Drawing Figures

STRIP-AUGER METHOD OF MINING THIN SEAMS OF HYDROCARBONACEOUS DEPOSITS

BACKGROUND OF THE INVENTION

This invention relates to a combination of strip and auger mining of thin seam hydrocarbonaceous deposits, particularly coal.

Coal which is man's most abundant source of energy, has been mined in the U.S. for about three hundred years. Deposits are known to exist in almost every state of the Union with the largest deposits of high quality coal such as bituminous and anthracite, being located east of the Mississippi River with particularly large deposits in such states as Pennsylvania, Ohio, West Virginia, Kentucky and Illinois. Coal exists in seams which vary in thickness from a matter of inches to hundreds of feet with an average thickness in the United States of about 5.5 feet. Most of the coal mined is found in seams which vary in thickness from 3 to 10 feet and which are located as surface outcroppings to depths of several thousand feet. The estimated recoverable coal reserves are on the order of 150 billion tons with annual 1983 production estimated at about 900 million tons.

Up to the start of the 20th century, most of the coal mined came from the eastern states which coincided with the largest concentrations of people and industry. In the eastern states a substantial portion of the coal lies in seams 100 or more feet underground. At that time essentially all of the coal was underground mined with access to the coal seam by adit entry (drift mining) or by a sloped or vertical shaft depending upon geological conditions. The method of extracting the coal is now almost universally mechanized in the traditional room and pillar method. Where surface conditions permit collapse or subsidence of the overburden, longwall mining is becoming more common, particularly with the development of new mining equipment. The same effect may be had by retreat mining, or removing the supports in a room and pillar mine when backing out of a fully developed mine or panel. Of more recent vintage is the use of auger mining in an underground mine. In this method a drill screw followed by scroll sections are power driven into the exposed face of a coal seam with a cylinder of coal removed. When combined with underground mining, auger mining is generally used only around the periphery of a working panel where a shallow overburden may cause squeezing or where there are bad roof conditions. As will be described below, auger mining is more typically used in conjunction with strip mining.

The advent of strip mining occurred during the later part of the 1800's and its growth generally paralleled the development of large earth moving equipment. The basic types of equipment used in strip mining are the power shovel and the dragline. From rather modest beginnings, shovels are now produced with dippers having a capacity in excess of 150 cubic yards and a dipper stick reach or working radius of up to 200 feet. Draglines are now produced with buckets up to 200 cubic yards with a boom of more than 400 feet and a working radius of over 300 feet. The principle operating difference between a shovel and a dragline is that a shovel will dig only at grade or above while a dragline will also dig as much as 185 feet below grade. The choice is often dictated by topography or the type of strip mining practiced. Bucket wheel excavators may also be used for strip mining but so far have found limited use in the United States.

The essentials of strip mining are to remove the earth overburden over a coal seam thereby exposing the bed so that it can be extracted in its entirety. There are two basic methods of strip mining—contour mining and open cast or area mining.

Contour mining is used in hilly or mountainous country where the coal seam outcrops on the side of the hill. The top of the coal seam is exposed by removing the overburden to ever increasing depths into the hill and dumping the overburden waste on the downslope of the hill or in valley fills. The overburden cut into the hill will proceed until the capacity of the excavating machine is reached or until the overburden can no longer be economically removed. The economics, of course, depend on the stripping ratio or the ratio of overburden thickness to the seam thickness. Seldom are stripping ratios in excess of 40 economically feasible. The effective or average stripping ratio may be reduced in those situations where more than one coal seam outcrops and more than one seam may be mined in successive stripping operations. In contour mining however, the height of the highwall is generally the controlling factor with about 150 feet being the practical limit.

Once the practical limit of contour mining is reached, coal recovery may be greatly improved by auger mining into the exposed seam at the base of the highwall. Augers with a diameter approximately equal to the seam thickness, up to about 48 inches, are power driven into the seam to depths of over 200 feet. Auger holes are generally spaced along the seam face to leave an unmined section or rib between holes sufficient to support the overburden for at least the short term. Typically about 40% to 60% of the exposed coal may be removed by this means thereby having the effect of improving the stripping efficiency.

Open cast or area mining is used in flat or gently rolling country which is underlain by a coal bed. A box cut or furrow of overburden is removed to expose the top surface of the coal seam where the coal is removed by normal means. A box cut generally progresses in a straight line from boundary to boundary. Each successive cut works into the exposed edge of the proceding cut and proceeds in the opposite direction with the overburden waste being placed in the void left by the previous cut or furrow. The process proceeds just like plowing a field--hence the sometime used name of furrow mining. The size of the box cut is determined by the size of the equipment used. The amount of overburden which can be removed is generally determined by economics which in turn relate to the stripping ratio and/or the coal thickness. For example, it is not practical to mine a seam less than 18 inches thick nor a field with a stripping ratio much over 50 or with an absolute overburden depth of more than 150 feet.

Contour mining, with or without auger mining assist, will recover coal which generally cannot be underground mined. The same may or may not be true of open cast mining. An underground mine generally requires 100 or more feet of overburden, must have a competent roof and should have access to coal seams of 30 inches or more. Open cast strip mining may be ideal at these cutoff limits. There are known to be extensive coal beds in the eastern part of the United States where the seams are too thin to underground mine and stripping ratios are too high to justify strip mining. There are large areas of Illinois, Indiana, Ohio and Kentucky which fall within these limitations.

Although not presently of much commercial significance, many of the open cast mining methods and limitations stated above equally apply to tar sands. There are presently known to be more than 500 separate tar sands deposits in 22 separate states in the United States having estimated recoverable reserves of over 30 billion barrels of extracted hydrocarbons. A substantial portion of these deposits can be open pit mined and as with coal there exists a significant portion which cannot be economically mined because of the high stripping ratio in conjunction with the limited hydrocarbon recovery possible with thin deposit seams.

It is, therefore, highly desirable to provide an improved and more efficient mining method for recovering thin seams of hydrocarbonaceous materials having high stripping ratios.

SUMMARY OF THE INVENTION

An improved method of surface mining thin seams of hydrocarbonaceous deposits combining open cast mining with auger mining which comprises stripping the overburden in a working pit to expose the hydrocarbonaceous deposit, extracting the hydrocarbonaceous material between the highwalls of the pit and extracting additional hydrocarbonaceous material by auger mining into the exposed deposit seam of at least one highwall of the working pit. In the novel method, the overburden from a box cut of the first working pit is removed exposing the top surface of the hydrocarbon deposits. The hydrocarbons are extracted from the bottom of the cut and then the exposed edge of the deposit seam at the bottom of one or both highwalls are auger mined to a predetermined depth. The box cut of the next working pit runs parallel to the first cut but spaced apart leaving an undisturbed portion of overburden between successive working pits. The overburden is removed from the second box cut and substantially deposited in the void left by the preceding box cut. The exposed hydrocarbonaceous deposits are extracted and the exposed seam auger mined into one or both highwalls. The steps of removing the overburden, extracting the exposed hydrocarbonaceous deposits and auger mining into one or both exposed highwalls is repeated in each successive working pit. The centerline of each pit runs parallel to but spaced apart from the centerline of the preceeding pit by a distance of from about one to two times the working radius of the stripping equipment. Substantially all of the overburden removed from the second and each successive working pit is deposited in the void of its preceding working pit.

The combination of steps in this novel mining method has the effect of reducing by half or more the effective stripping ratio of the mineral deposit.

A more detailed explanation of the invention is given in the following description and appended claims taken in conjunction with the accompanying drawings.

DETAILED DESCRIPTION OF THE PREFERRED EMBODIMENTS

Figure 1:
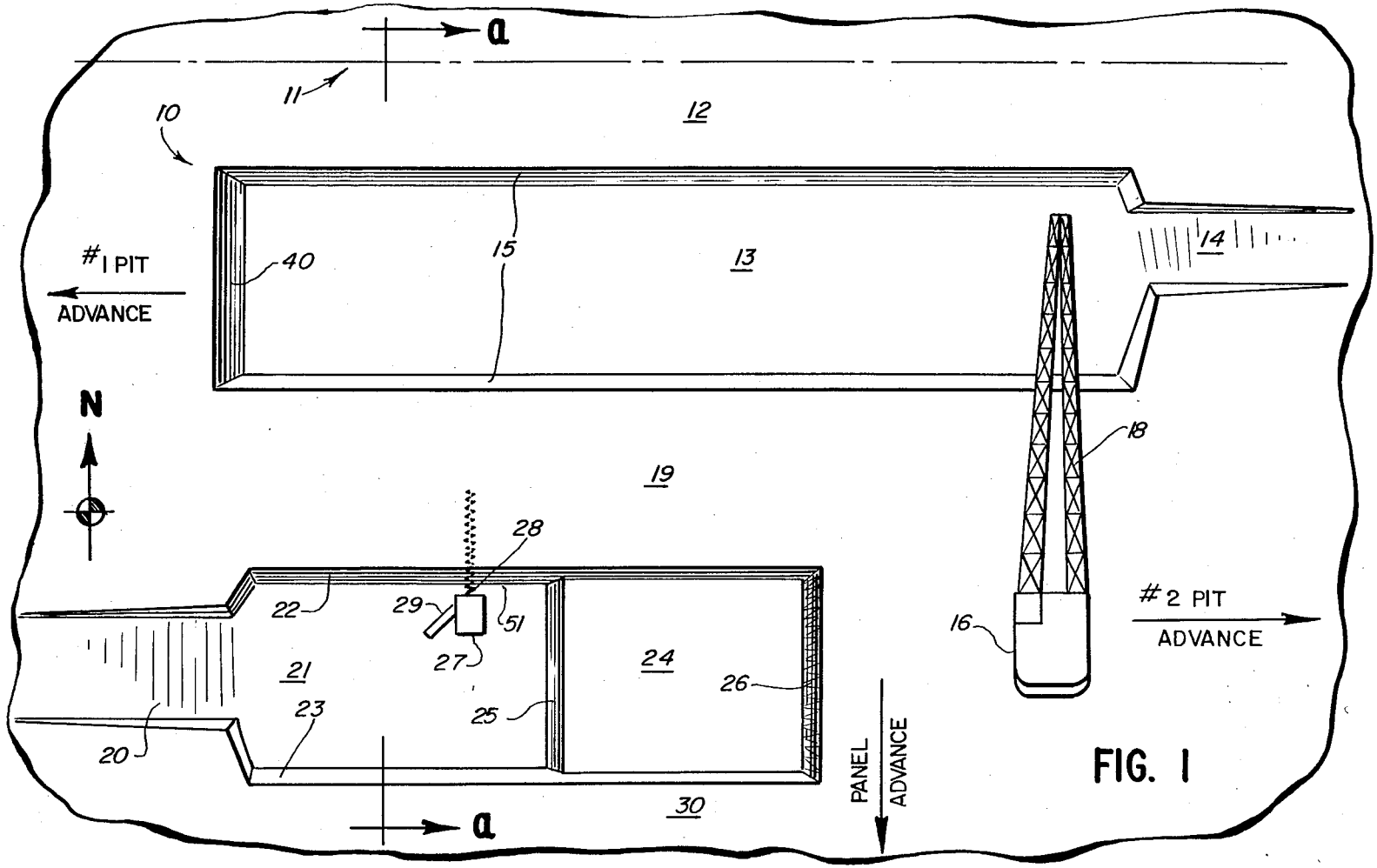
FIG. 1 is a plan view of a combined open cast strip mining and auger mining operation in accordance with the principles of the present invention.

Referring to the drawings, a coal stripping operation 10 is shown within the boundaries of a coal lease. A first pit 13 which runs from east to west parallel with the coal property line 11, is shown completed leaving highwalls 15 and ramp 14, used by coal removal equipment. Pit 13 was spaced away from property line 11 to leave a portion of undisturbed overburden 12 from about 60 to about 100 feet wide. The coal seam 41 at the bottom of pit 13 between highwalls 15 was removed by conventional power shovel or front end loader onto roadway trucks which enter and leave pit 13 via ramp 14. As coal 41 was removed to expose coal seam faces 53 and 54, sections 56 and 42 of the coal seam were augered out. At the dead end highwall 40 the exposed coal seam (not shown) was also augered out to the western edge of the property or the panel limit. The overburden taken from pit 13 has been hauled away for disposal elsewhere, temporarily stored on the ground surface of the undisturbed portion 12 for subsequent spreading over the entire mining area or a combination of both disposal methods. All the equipment has been moved south to start next pit 21 leaving undisturbed overburden portion 19 between completed pit 13 and the adjacent or successive working pit 21 which now proceeds in a west to east direction parallel to property line 11 and first pit 13.

Dragline 16, walking or crawling over the natural ground surface opens pit 21 by first cutting ramp 20, an incline from ground surface to the bottom of pit 21. The length of the incline will depend upon the depth of the coal seam since the ramp must maintain a grade of less than 20% to permit negotiation by the coal hauling trucks. Dragline 16 removes the overburden by positioning bucket 17 on the ground surface with boom 18 and drawing the bucket towards the dragline. Some or all of the overburden may first have to be drilled and blasted, depending on the geology. When the ramp cut reaches the top surface of coal bed 24, then the full width box cut of pit 21 is taken. The width of the box cut will be determined primarily by the size of dragline 16 and generally will be about one fourth to about one half or more of the working radius of the dragline. The working radius is generally considered to be the distance between the furthest throw point and the nearest drag point of the dragline bucket. As the thickness of the overburden increases, the width of the cut generally decreases. In a typical operation of this type, dragline 16 is equipped with a 20 to 40 cubic yard bucket 17 with boom 18 being on the order of 300 feet long with a working radius of about 240 feet. The coal seam is on the order of 24 inches thick and the overburden thickness on the order of about 40 to about 150 feet. The width of box cut 21 typically is about 80 to 100 feet wide at the bottom and about 100 to 140 feet wide at the top depending on the geology. A box cut less than 40 feet is not practical while one wider than 150 feet at the bottom would require massive size equipment. In the event substantial blasting is required in removing the overburden it may be desirable to first cut key slots at one or both sides of pit 21 to therefore define highwalls 22 or 23 before removing the major middle portion. As the box cut is complete and pit 21 advances in an easterly direction the top of coal seam 24 is exposed. Once pit 21 advances enough that working headwall 26 is about 50 feet beyond the bottom of ramp 20, excavation of coal seam 24 may commence. The coal is broken up and loaded onto 15 to 30 ton highway trucks with a small power shovel or front end loader (equipment not shown). The removal of the coal progresses concurrently with removal of the overburden so long as the distance between overburden headwall 26 and coal seam face 25 are sufficient for safety purposes.

As extraction of the coal seam progresses so that coal face 25 is on the order of 50 feet or more beyond the bottom of ramp 20, augering the exposed coal seam faces 51 and 52 may begin. Auger power drive unit 27 is put in place before seam face 51, generally on moveable iron rails to facilitate lateral movement. Screw and scroll auger sections 28 are mounted and driven into coal seam section 42 beneath undisturbed overburden portion 19. The auger diameter is typically slightly smaller than the seam thickness. Within limits the auger lateral direction can be controlled by variations in initial direction, torque and forward pressure. Vertical wander is typically a function of the floor and roof of the coal seam. Competent rock will generally prevent the auger from wandering out of the seam.

Figure 2:
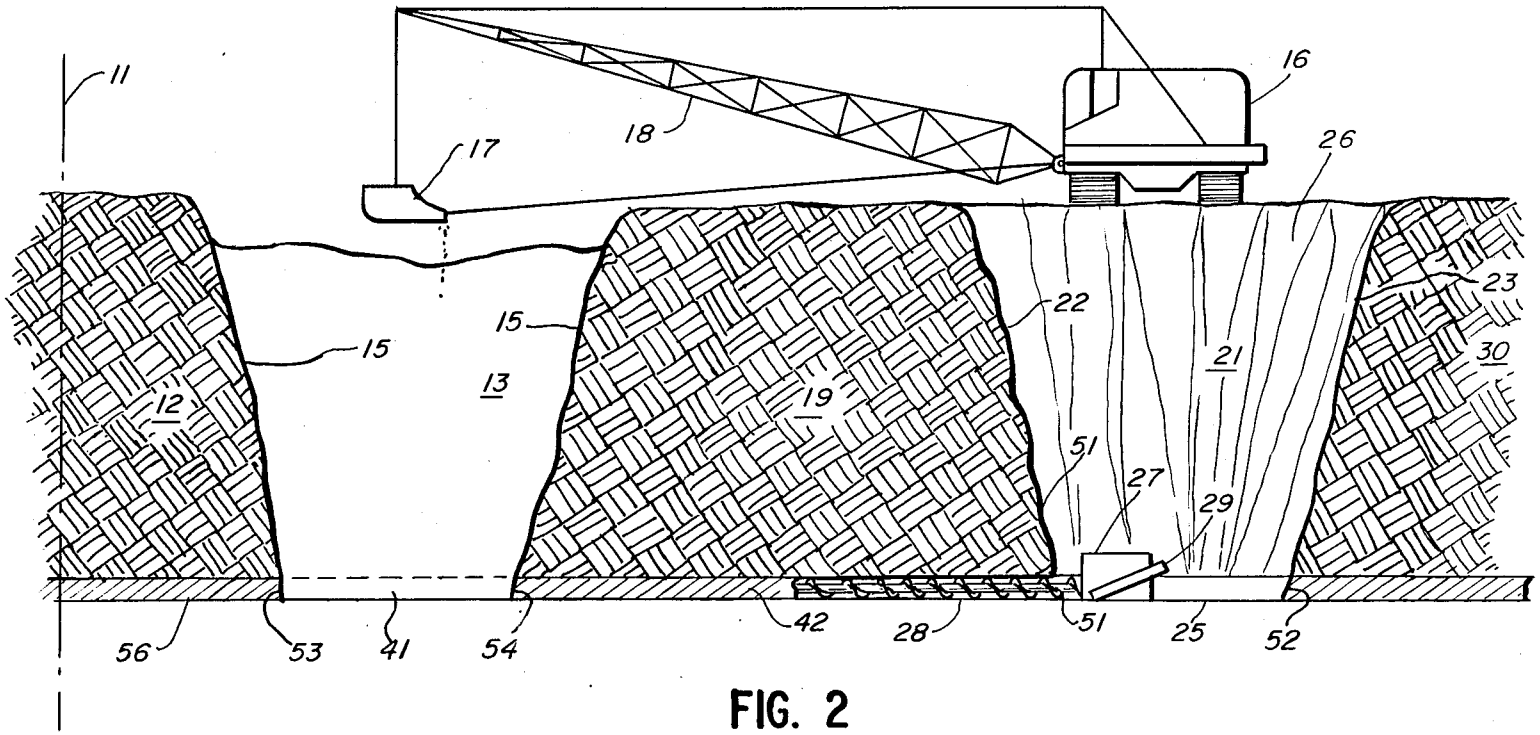
FIG. 2 is a cross-sectional view of the mining operation taken substantially along line a-a of FIG. 1.

The depth to which the seam is augered is dictated by a variety of factors. In one embodiment (see FIG. 2), the overburden stripped from pit 21 is dumped by dragline 16 directly into the void of preceding pit 13. In this case the center to center distance between pits 13 and 21 is approximately equal to the working radius of boom 18. If boom 18 has a working radius of about 240 feet, the bottom width of undisturbed overburden portion 19 is on the order of about 120 feet. Under these conditions, coal seam section 42 could be auger mined completely from first face 51 rather than augered to a depth of about 60 feet from both seam faces 54 and 51. There are practical limits as to how deep a seam can be augered such as ability to control direction, that effect the decision whether to auger from one or the two opposing seam faces. As the auger mining proceeds, additional scroll sections are added to auger 28 as the depth of penetration increases. The auger mined coal is conveyed out of the hole and onto belt loader 29 which empties directly into an awaiting truck. Once the maximum depth is reached auger 28 is withdrawn, power unit 27 is moved laterally to the next augering position and the process repeated. An unaugered portion or rib is left undisturbed between each auger hole to prevent breakout of the auger from one hole to another and also to support the overburden from collapse. The width of the ribs in general are a compromise between providing support for the overburden and maximizing coal recovery.

Figure 3:
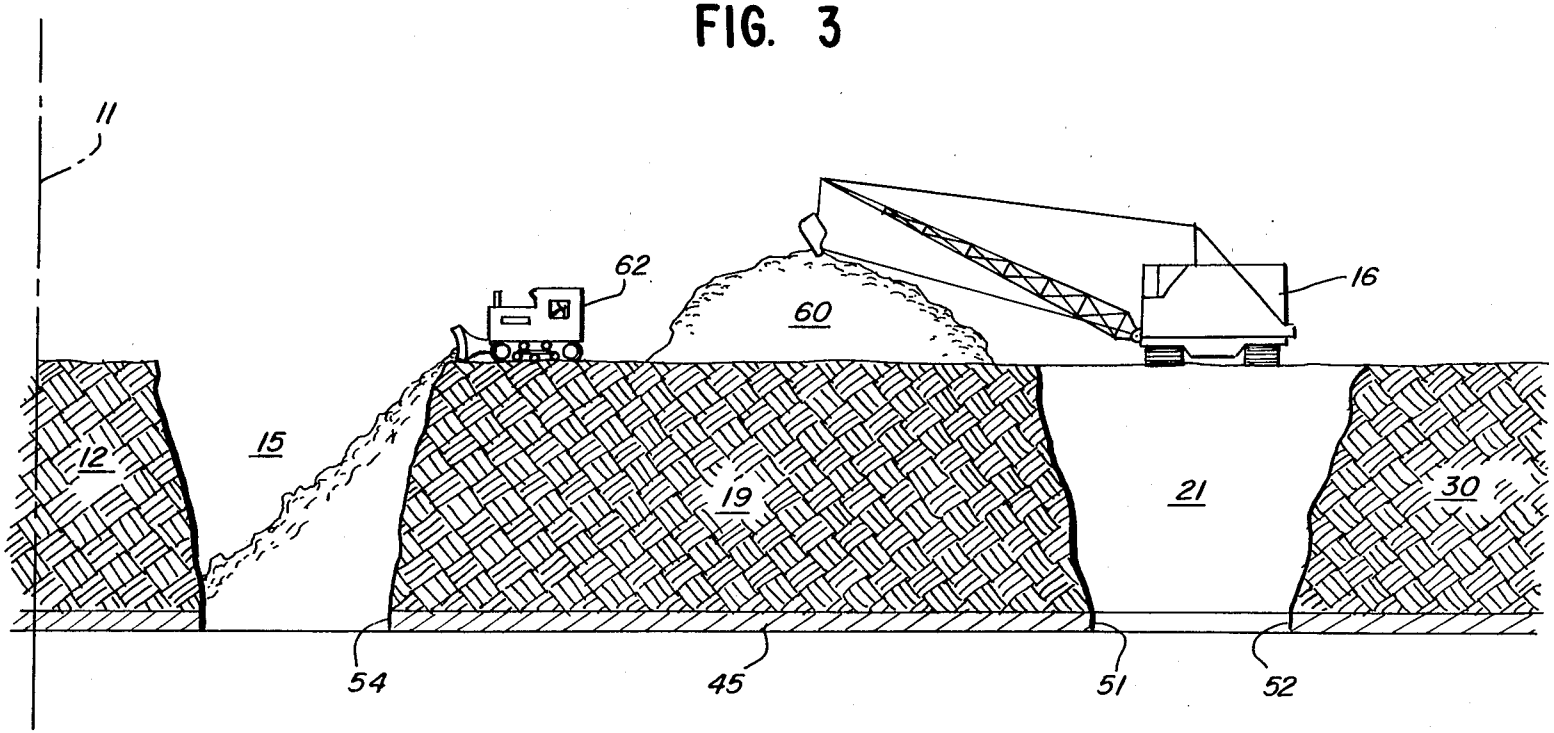
FIG. 3 is a cross-sectional view of an optional mining operation taken substantially along line a-a of FIG. 1.

In another embodiment (see FIG. 3), the center to center distance between pits 13 and 21 can be made twice the working radius of boom 18, i.e., about 480 feet in this example. In this case stripped overburden (60) removed from pit 21 is temporarily deposited on the ground surface of undisturbed overburden portion 19 to be later redeposited into the void of pit 13 by bulldozer 62 or similar piece of earthmoving equipment. The effect of this embodiment is to double the width of undisturbed overburden portion 19 and correspondingly double the length of coal seam section 42 to be auger mined. It is unlikely that a small diameter auger can be driven to a depth of 240 feet so it then becomes necessary for coal seam section 42 to be auger mined from both seam faces 51 and 54. The advantage of doubling the width of undisturbed overburden portion 19 is to reduce the costly expense of removing overburden. The offsetting disadvantages are to double the amount of auger mining, the need for additional earth moving equipment and worst of all reducing the recovery rate since open cast stripping of coal from an exposed seam yields about 95% recovery while auger mining typically yields less than 75% and often less than 60%. The choice between the alternate methods is invariably site specific.

The second pit 21 is advanced in an easterly direction to the geologic limit or as close to the property limit as is practicle without dragline 16 encroaching on adjacent property. Second pit 21 is terminated in a deadend highwall (not shown) about 60 feet from the east property line. Second pit 21 is completed by auger mining into the exposed seam face of the deadend highwall to a depth of 60 feet or to the property line. Dragline 16 traverses south over the undisturbed portion of overburden at the end of second pit 21 to the next working pit and commences working the next pit in a westerly direction parallel to pits 13 and 21 but spaced apart by undisturbed overburden portion 30.

The above described steps would be repeated to completion of the property. The final working pit may be filled with the waste overburden of the first working pit or with waste from some other source to complete project reclamation.

Among the advantages of the above mining method are:

1. Permits the economic recovery of thin seam coal;
2. Reduces the stripping ratio by one half or more;
3. Permits more effective use of coal mining equipment;
4. Lowers coal recovery costs;
5. More ecologically acceptable; and
6. Increases speed of coal recovery.

Although embodiments of this invention have been shown and described it is understood that various modifications and rearrangements of equipment and dimensions and as well as rearrangements and combinations of steps in the method can be made by those skilled in the art without departing from the novel spirit and scope of this invention.

I claim:

1. A method of area mining hydrocarbonaceous deposits comprising the steps of:

(a) forming a first working pit by stripping the overburden to expose the hydrocarbonaceous deposit;

(b) extracting the hydrocarbonaceous material between the highwalls of said first working pit;

(c) extracting additional hydrocarbonaceous material by auger mining into the exposed deposit seam of at least one highwall of said first working pit;

(d) repeating the operations of steps (a), (b) and (c) in a second and additional successive working pits until the property or geologic limits of said deposit are reached wherein said second and each of said successive working pits are parallel to but spaced apart from the preceding working pit leaving an undisturbed portion of overburden therebetween.

2. The method of claim 1 wherein the hydrocarbonaceous material is coal or tar sands.

3. The method of claim 1 wherein the stripping operation of step (a) is carried out by a dragline.

4. The method of claim 1 wherein the bottom width of said working pit is from about one fourth to about one half the working radius of said dragline.

5. The method of claim 1 wherein the stripping ratio of a working pit is from about 20 to about 75.

6. The method of claim 1 wherein the depth of auger mining is from about one half to about one times the bottom width of said undisturbed portion or overburden between any two adjacent or successive working pits.

7. The method of claim 6 wherein the bottom width of said undisturbed portion of overburden between any two adjacent or successive working pits is from about one to about two times the working radius of said dragline.

8. The method of claim 1 wherein the overburden removed from the second and each successive working pit is disposed in its preceding working pit.

9. The method of claim 1 wherein the overburden removed from the second and each successive working pit is temporarily deposited atop the undisturbed portion of overburden between said working pit and its preceding working pit to be subsequently redeposited into said preceding pit by independent earthmoving equipment.

10. A method of area mining coal deposits comprising the steps of:

(a) in a first working pit, stripping the overburden to expose a coal seam;

(b) extracting the exposed coal seam between the highwalls of said first working pit;

(c) auger mining into the exposed coal seam of at least one highwall to a depth of about one-half to about two times the width of said first working pit;

(d) repeating the operations of steps (a), (b) and (c) in a second and additional successive working pits parallel to but spaced apart from said first pit until the property or geologic limits of said coal deposits are reached wherein said second and each of said successive working pits are parallel to but spaced apart from the preceding working pit leaving an undisturbed portion of overburden therebetween having a width of about one to about two times the depth of said auger mining.

11. The method of claim 10 wherein the stripping operation of step (a) is carried out by a dragline.

12. The method of claim 10 wherein the stripping ratio of a working pit is from about 20 to about 75.

13. The method of claim 10 wherein the bottom width of a working pit is from about 40 feet to about 150 feet.

14. The method of claim 10 wherein the overburden removed from the second and each successive working pit is deposited in its preceding working pit.

15. The method of claim 10 wherein the overburden removed from the second and each successive working pit is temporarily deposited atop the undisturbed portion of overburden between said working pit and its preceding working pit to be subsequently redeposited into said preceding pit by independent earthmoving equipment.

16. The method of claim 10 wherein the working radius of said dragline is from about 80 to about 300 feet.

17. A method of surface mining thin seam coal deposits comprising the steps of:

(a) advancing a first working pit essentially parallel to but spaced apart from a selected property or geologic limit of the coal deposit by stripping the overburden and placing the removed overburden on the ground atop the undisturbed overburden portion between said property limit and said working pit;

(b) extracting the exposed coal seam between the highwalls of said first working pit;

(c) auger mining the exposed coal seam of at least one highwall of said first working pit;

(d) advancing in the opposite direction a second working pit parallel to but removed from the preceding pit by a predetermined distance while placing the removed overburden into the void of said preceding pit;

(e) repeating the operations of steps (b) and (c) in said second working pit;

(f) repeating the operations of steps (d) and (e) in a next and successive working pits to the property or geologic limit of said coal deposit; and (g) disposing of the overburden placed on the ground surface in step (a).

18. The method of claim 17 wherein the stripping operation of step (a) is carried out by a dragline.

19. The method of claim 17 wherein the width of any given working pit is from about one fourth to about one half the working radius of said dragline.

20. The method of claim 17 wherein the stripping ratio of a working pit is from about 20 to about 75.

21. The method of claim 17 wherein said predetermined distance of step (d) is equal to about the maximum working radius of said dragline.

22. The method of claim 17 wherein the depth of augering in step (c) is from about one half to about one times the bottom width of said undisturbed overburden portion.

* * * * *

UNITED STATES PATENT OFFICE

CERTIFICATE OF CORRECTION

Patent No. 4,589,700 Dated May 20, 1986

Inventor(s) Schroder, Michael L.

It is certified that error appears in the above-identified patent and that said Letters Patent are hereby corrected as shown below:

| Column | Line | |
|---|---|---|
| 2 | 45 | "proceding" should be - preceding - |

Signed and Sealed this

Tenth Day of March, 1987

*Attest:*

DONALD J. QUIGG

*Attesting Officer*

*Commissioner of Patents and Trademarks*